US008869980B2

(12) United States Patent
Berggren

(10) Patent No.: US 8,869,980 B2
(45) Date of Patent: Oct. 28, 2014

(54) CONTAINER FOR SNUS

(75) Inventor: Adam Berggren, Malmo (SE)

(73) Assignee: Fielder & Lundgren AB, Malmo (SE)

( * ) Notice: Subject to any disclaimer, the term of this patent is extended or adjusted under 35 U.S.C. 154(b) by 0 days.

(21) Appl. No.: 13/381,324

(22) PCT Filed: Jul. 15, 2010

(86) PCT No.: PCT/IB2010/001736
§ 371 (c)(1),
(2), (4) Date: Mar. 22, 2012

(87) PCT Pub. No.: WO2011/001284
PCT Pub. Date: Jan. 6, 2011

(65) Prior Publication Data

US 2012/0168329 A1 Jul. 5, 2012

(30) Foreign Application Priority Data

Jun. 29, 2009 (GB) ..... 0911180.8

(51) Int. Cl.
*A24F 23/00* (2006.01)
*A24F 23/04* (2006.01)
*B65D 51/28* (2006.01)

(52) U.S. Cl.
CPC ..... *B65D 51/28* (2013.01); *B65D 2251/1075* (2013.01); *B65D 2209/00* (2013.01); *A24F 23/04* (2013.01)
USPC ..... 206/256; 206/258; 222/517; 222/498; 215/237

(58) Field of Classification Search
CPC .. B65D 5/5495; B65D 25/2855; B65D 47/00; B65D 85/10; B65D 5/722; B65D 5/727; B65D 2251/1066; B65D 2209/00; B65D 51/28; B65D 47/087; A24F 23/04
USPC ..... 206/256, 268; 222/556, 517, 498; 215/237
See application file for complete search history.

(56) References Cited

U.S. PATENT DOCUMENTS 3,348,724 A 10/1967 Rosso
3,419,198 A * 12/1968 Pettersen ..... 222/541.2
(Continued)

FOREIGN PATENT DOCUMENTS

CA 2223335 6/1999
CA 2252215 5/2000
(Continued)

OTHER PUBLICATIONS

International Search Report and Written Opinion, mailed Oct. 8, 2010, for PCT International Application No. PCT/IB2010/001736, filed Jul. 15, 2010.

*Primary Examiner* — Andrew Perreault
*Assistant Examiner* — James M Van Buskirk
(74) *Attorney, Agent, or Firm* — N W Poulsen

(57) ABSTRACT

A container for snus comprising a compartment and a cover enclosing said compartment, the cover having a hinge line extending thereacross to divide said cover into a push section and a hinge section, wherein the hinge section is rotatable relative to the push section about the hinge line and the push section is pivotally mounted to the compartment such that, when a user urges the push section into the compartment, the hinge section acts on a fulcrum portion and is urged to rotate about the hinge line relative to the push section to move the hinge section from a closed position to an open position and allow access to the compartment.

15 Claims, 5 Drawing Sheets

(56) References Cited

U.S. PATENT DOCUMENTS

| | | | | | |
|---|---|---|---|---|---|
| 4,607,768 | A | * | 8/1986 | Taber et al. | 222/556 |
| 4,898,292 | A | * | 2/1990 | VerWeyst et al. | 215/237 |
| 4,901,892 | A | * | 2/1990 | Song | 222/498 |
| 5,657,802 | A | | 8/1997 | Kim | |
| 6,158,632 | A | * | 12/2000 | Ekkert | 222/556 |
| 6,932,220 | B2 | * | 8/2005 | Byun | 206/581 |
| D640,546 | S | * | 6/2011 | Berggren | D9/428 |
| D650,269 | S | * | 12/2011 | Berggren | D9/428 |
| D660,693 | S | * | 5/2012 | Berggren | D9/428 |
| 2005/0173272 | A1 | * | 8/2005 | Lemmons, IV | 206/256 |
| 2007/0175909 | A1 | | 8/2007 | Solowiejko | |

FOREIGN PATENT DOCUMENTS

| | | |
|---|---|---|
| EP | 0611167 | 8/1994 |
| WO | 02/076844 | 10/2002 |
| WO | 2005/016036 | 2/2005 |

* cited by examiner

CONTAINER FOR SNUS

CLAIM FOR PRIORITY

This application is a National Stage Entry entitled to and hereby claims priority under 35 U.S.C. §§365 and 371 to corresponding PCT Application No. PCT/IB2010/001736, filed Jul. 15, 2010, which in turn claims priority to British Application Serial No. GB 0911180.8, filed Jun. 29, 2009. The entire contents of the aforementioned applications are herein expressly incorporated by reference.

The present invention relates to a container for tobacco industry products, preferably smokeless products and most preferably snus. In particular, the present invention relates to a container for snus comprising a compartment with a lid that is openable to allow access to the compartment.

Current packing for tobacco products such as snus and snuff comprises a container for holding the product formed from a base and a resealable lid to maintain its freshness. Some tobacco products including snus are discarded after use, preferably in a suitable place such as a bin or the like to avoid littering. However, littering of tobacco products is a common problem as its consumption is not always restricted to a designated area and so a user may not always be in the vicinity of a bin when they need to dispose of the consumed tobacco product.

To overcome the above mentioned problem, it is known to provide a container for holding fresh snus with a separate compartment for temporarily receiving consumed snus. A disposal compartment can either be formed in the base or the lid, closable with a cover so that the user can temporarily store used tobacco products until they are in the vicinity of a bin.

The compartment is defined by a recess in the lid to which a cover is detachably mounted. The cover of such a container is clipped onto the lid however, the cover may accidentally detach from the lid causing the discarded snus to fall out or the cover may be displaced.

A container having a secondary compartment wherein the cover is connected to the lid via a hinge is also known. However, such a cover can be difficult to open to access the compartment.

The present invention seeks to provide a container for snus that overcomes or substantially alleviates the problems mentioned above.

According to the present invention, there is provided a container for snus comprising a compartment and a cover enclosing said compartment, the cover having a hinge line extending thereacross to divide said cover into a push section and a hinge section, wherein the hinge section is rotatable relative to the push section about the hinge line and the push section is pivotally mounted to the compartment such that, when a user urges the push section into the compartment, the hinge section acts on a fulcrum and is urged to rotate about the hinge line relative to the push section to move the hinge section from a closed position to an open position and allow access to the compartment.

Preferably, the fulcrum is disposed in the compartment.

Conveniently, the fulcrum divides the compartment into two discrete chambers.

The container for snus may be configured such that product is stored in one of the two discrete chambers and the push section is urged into the other discrete chamber.

Advantageously, the fulcrum is a wall upstanding in the compartment.

Preferably, the compartment is a secondary compartment and the container for snus further comprises a main compartment.

The container for snus may further comprise a base and a lid, wherein the base and the lid define the main compartment.

In a preferred embodiment the secondary compartment is formed in the lid.

The cover may be pivotally mounted to the lid by a hinge.

In one embodiment, the hinge comprises a hinge cavity extending from the secondary compartment and a projecting portion extending from an edge of the cover which is disposed in the hinge cavity and pivotally mounts to side walls of said hinge cavity.

In another embodiment, the hinge comprises a first hinge portion extending from a lower face of the cover and a second hinge portion upstanding in the secondary compartment, wherein the first hinge portion is pivotally mounted to the second hinge portion.

Preferably, the hinge line comprises a line of reduced thickness formed in the cover, and extending thereacross to divide the cover into the hinge section and the push section.

Conveniently, the line of reduced thickness is a channel formed in the lower surface of the cover. Advantageously, the cover is circular.

Preferably, a rib is formed on the cover to latch on the compartment to retain the cover in the closed position.

Embodiments of the present invention will now be described by way of example only, with reference to the accompanying drawings, in which.

Figure 1:
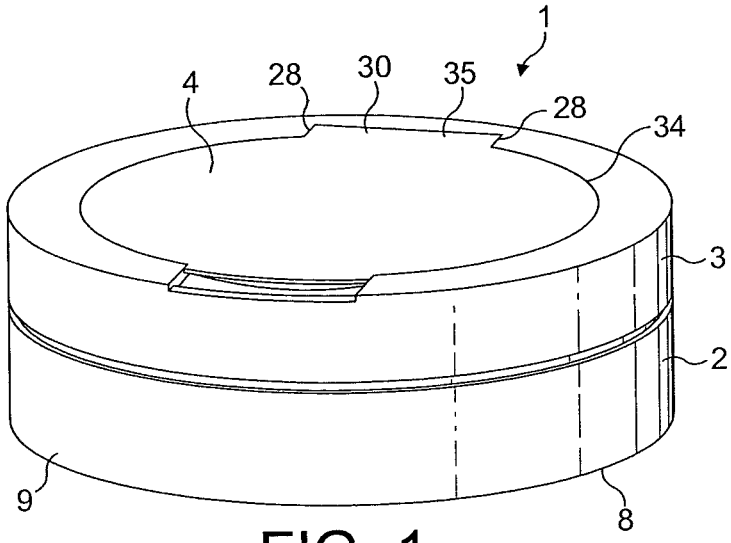
FIG. 1 shows a perspective view of a container for snus according to the present invention.
Figure 2:
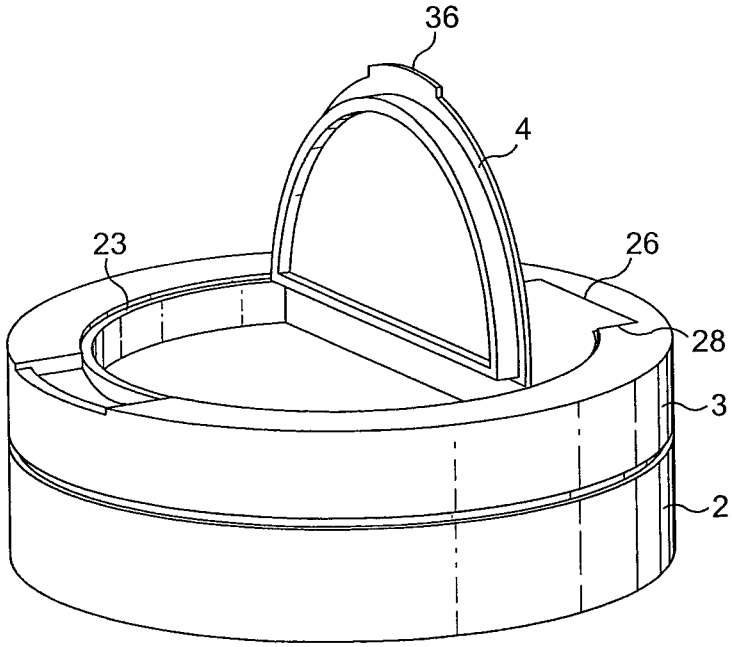
FIG. 2 shows a perspective view of the container for snus shown in FIG. 1 with a cover in an open position.

Referring now to the Figures, there is shown in FIGS. 1 to 4 a container 1 comprising a base 2, a lid 3 and a cover 4. The base 2 and the lid 3 define a main compartment or storage space 5 for holding fresh snus. The lid 3 and the cover 4 define a secondary storage space 6 for holding consumed snus.

The base 2 has a circular bottom 8 and a circumferentially extending side wall 9 which upstands from the bottom 8. An annular ridge 11 is formed on an outer surface 10 of the side wall proximate to a brim 12 of said side wall 9, to removably mount the lid 3 to the base 2, as will be explained hereinafter.

The lid 3 includes a circumferentially extending side wall 13 which extends vertically from a top 14 of the lid 3. The thickness of the lid side wall 13 and the diameter of the top 14 are of similar dimensions to the side wall 9 and bottom 8, respectively, of the base 2. The main storage space 5 is closed by a recess defined by the lid top 14 and side wall 13 receiving an upper end of the base 2 so that the side walls 9 and 13 of the lid 3 and base 2 respectively abut and thereby seal the space 5 defined therein. As the lid 3 is positioned on the base 2, the lid side wall 13 encloses the upper end of the base 2 and the annular ridge 11 is received in an annularly extending hollow 15 formed in an inner surface 16 of the base side wall 9 to locate the lid 3 and limit movement of the lid 3 relative to the base 2.

Although one means of removably mounting the lid 3 to the base 2 is described above, it will be understood that the lid 3 may be mounted to base 2 by means of a snap lock, a slip fit or other conventional means such that, in an alternative embodiment, the container relies on friction or interference between the lid 3 and base 2 to maintain the seal.

It is envisaged that the base 2, lid 3 and cover 4 of the container are manufactured from a rigid material, for example a moulded plastic.

The top 14 of the lid 3 further comprises a compartment 17 formed therein in which the cover 4 is received to cover an opening to the compartment 17. A fulcrum wall 18 upstands from a base 19 of the compartment 17 and divides the compartment 17 into discrete first and second chambers 20,21. The first chamber 20 defines the secondary storage space 6 for holding consumed snus, as will become apparent below. An arcuately extending shoulder 23 is formed around the first chamber 20. Said shoulder 23 is of a depth similar to the thickness of the cover 4 and an upper end 24 of the fulcrum wall 18 extends to the shoulder 23 so that by positioning the cover 4 on the shoulder 23 a flush outer finish of the lid 3 is produced. The upper end 24 of the fulcrum wall 18 has a bevelled surface facing towards the second chamber 21, for reasons that will be explained hereinafter.

In this embodiment it is envisaged that the first chamber 20 has a greater depth than the second chamber 21. An access cavity 25 and a hinge cavity 26 extend from the first and second chambers 20,21 respectively, and are formed diametrically opposite each other. The hinge cavity 26 is open to the second chamber 21 and comprises a rear face 27 and opposing parallel side faces 28 which extend between the rear face 27 and the second chamber 21. A cylindrical hole extends into each side face 28 to receive pivot rods (not shown) of a primary hinge 30 of the cover 4, as will be explained hereinafter. The access cavity 25 is divided from the first chamber 20 by a panel 29 spanning the access cavity 25 to continue the line of the shoulder 23 therearound. A rib 31 extends along the panel 29 parallel to the shoulder 23 extending into the first chamber 20 to fixedly locate the cover 4, as will be explained hereinafter.

The cover 4 comprises an upper face 32, a lower face 33 and a circumferential edge 34. The cover is secured to the lid 3 by the primary hinge 30 which comprises a projecting portion 35 extending from the circumferential edge 34 of the cover 4 and below the plane of the cover lower face 33. The projecting portion 35 has a width slightly smaller than the width of the hinge cavity 26 between the opposing side faces 28 so that the projecting portion 35 is received in the hinge cavity 26. Pivot rods (not shown) extend from opposing sides of the projecting portion 35 and are received in the cylindrical holes (not shown) in each side face 28 of the hinge cavity 26. The pivot rods define the axis of rotation of the primary hinge 30 and are rotatable in the cylindrical holes so that the cover 4 is pivotable about the lid 3.

The diameter of the cover 4 is slightly smaller than the diameter of the annular shoulder 23 so that the cover 4 is received in the compartment 17 to cover the opening to the secondary compartment 6. A lip 36 extends from the cover circumferential edge 34 diametrically opposite the projecting portion 35 and extends over the panel and partially covers the access cavity 25 when the cover 4 is in a closed.

The cover 4 further comprises a line of reduced thickness extending across the cover 4 to form a hinge line. The line of reduced thickness is formed by a V-shaped channel in the lower face 33 of the cover 4 which extends across the lower face to allow the cover to flex about the said line and define a secondary hinge 37. The secondary hinge 37 extends along an axis parallel to the axis of rotation of the primary hinge 30 and divides the cover 4 into a push section 38, formed between the primary hinge 30 and the secondary hinge 37, and a hinge section 39 which is pivotable relative to the push section about the secondary hinge 37.

Although the secondary hinge 37 is formed by the channel in the lower face 33, it will be understood that the invention is not limited thereto, and that the secondary hinge 37 can be formed from any means that enables the hinge section 39 and the push section 38 to pivot relative to each other. An advantage of the secondary hinge 37 being formed from a line of reduced thickness of the cover 4 is that it is simple to manufacture and the hinge section 39 and push section 38 are integrally formed.

The push and hinge sections 38,39 lie on the same plane when the lid 3 and cover 4 are assembled and the cover is in a closed position, that is the cover 4 is disposed to cover the opening to the first chamber 20 which defines the secondary compartment 6 for holding consumed snus and an outer edge of the lower face 33 of the cover 4 lies against the shoulder 23.

When the cover 4 is in the closed position, the secondary hinge 37 lies proximate to the upper end 24 of the fulcrum wall 18 and extends parallel to the fulcrum wall 18. The upper end 24 of the fulcrum wall 18 is located to lie against the hinge section 39 side of the secondary hinge 37, such that the hinge section 39 acts against said upper end 24 when the push section 38 is depressed, as will become apparent below.

A flange 40 extends downwardly from the lower face 33 of the cover 4 extending around the periphery of the hinge section 39, recessed from the edge thereof. The flange 40 is recessed from the edge of the hinge section 39 to allow the cover 4 to lie in a closed position without the flange 40 contacting the shoulder 23 or the upper end of the fulcrum wall 18. A rib 42 is formed on an outer surface of the flange 40 to correspond with the rib 31 extending from the panel 29 such that, when the cover 4 is in its closed position, the flange rib 42 latches over the panel rib 31 such that the panel rib 31 retains said flange rib 42 in place and prevents the hinge section 39 from pivoting unless a sufficient force is applied to move the flange rib 42 over the panel rib 31.

Operation of the container for snus according to the above exemplary embodiment will now be described with reference to FIGS. 1 to 4.

Figure 3:
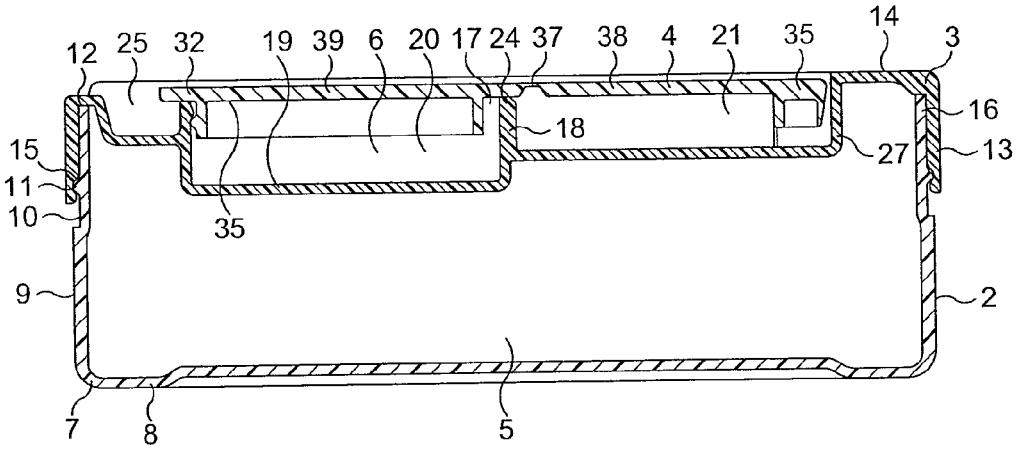
FIG. 3 shows a cross-sectional view of the container for snus shown in FIG. 1 with the cover in a closed position.
Figure 4:
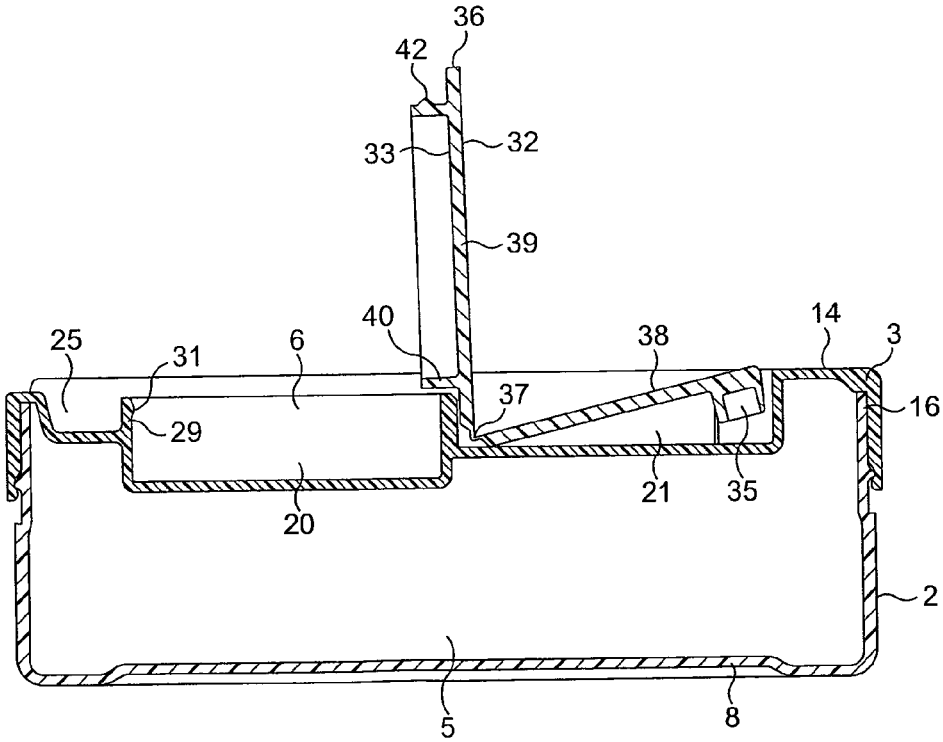
FIG. 4 shows a cross-sectional view of the container for snus shown in FIG. 1 with the cover in an open position.
Figure 5:
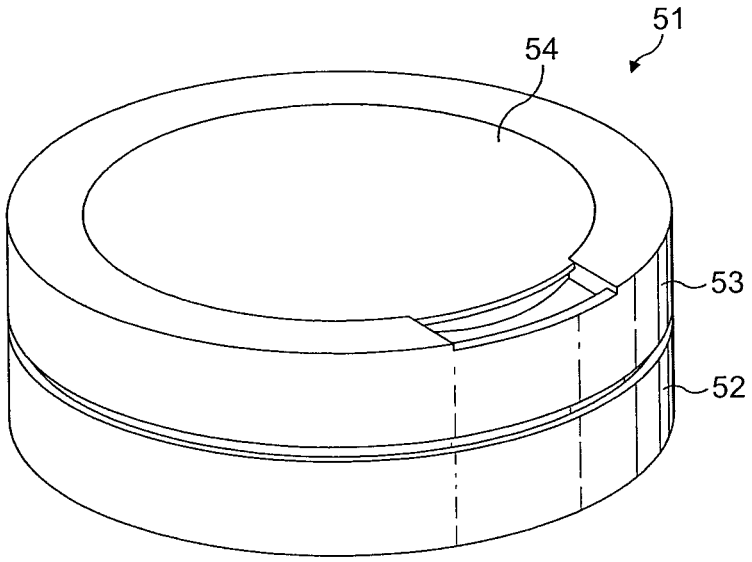
FIG. 5 shows a perspective view of a container for snus according to another embodiment of the present invention.
Figure 6:
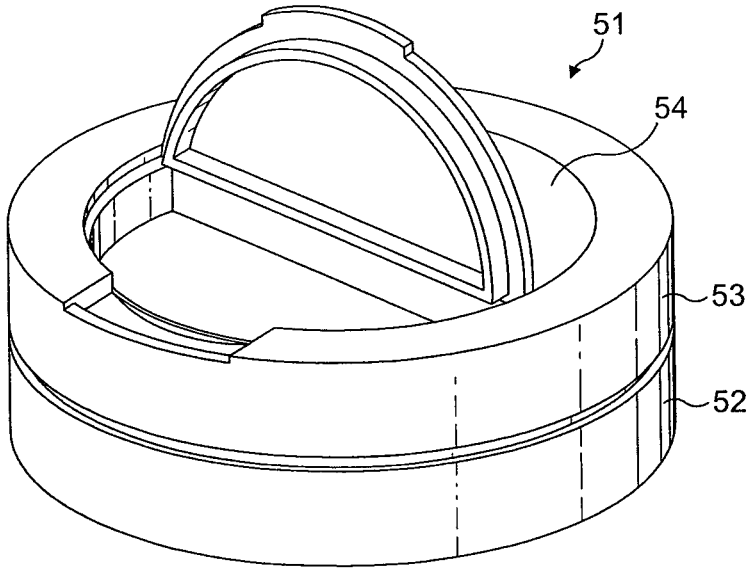
FIG. 6 shows a perspective view of the container for snus shown in FIG. 5 with a cover in an open position.
Figure 7:
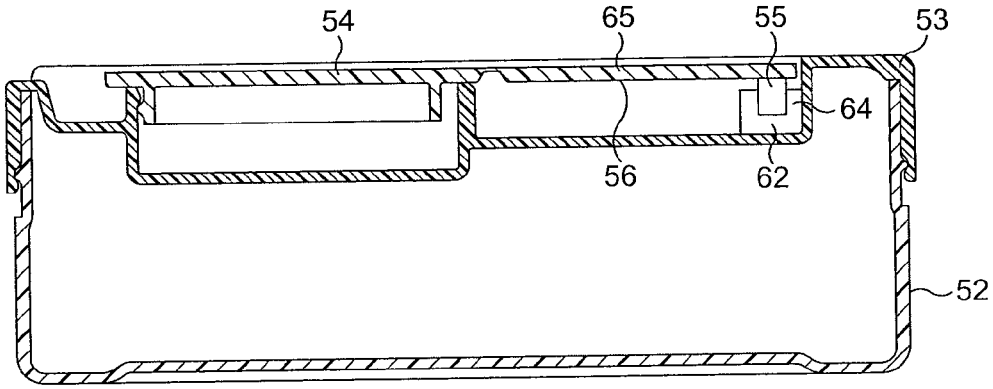
FIG. 7 shows a cross-sectional view of the container for snus shown in FIG. 6.
Figure 8:
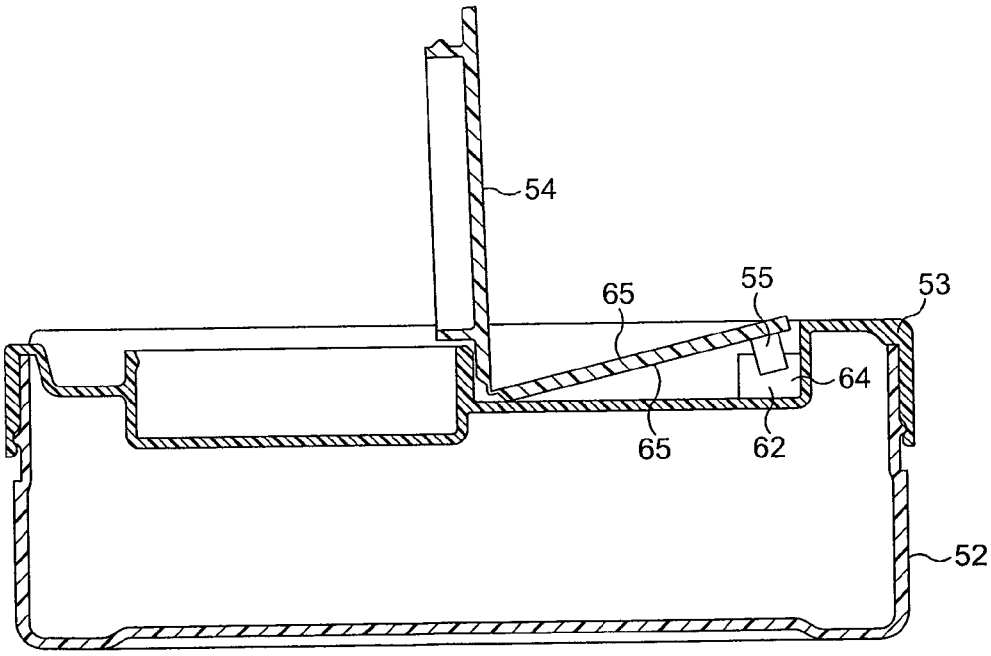
FIG. 8 shows a cross-sectional view of the container for snus shown in FIG. 7 with the cover in an open position.
Figure 9:
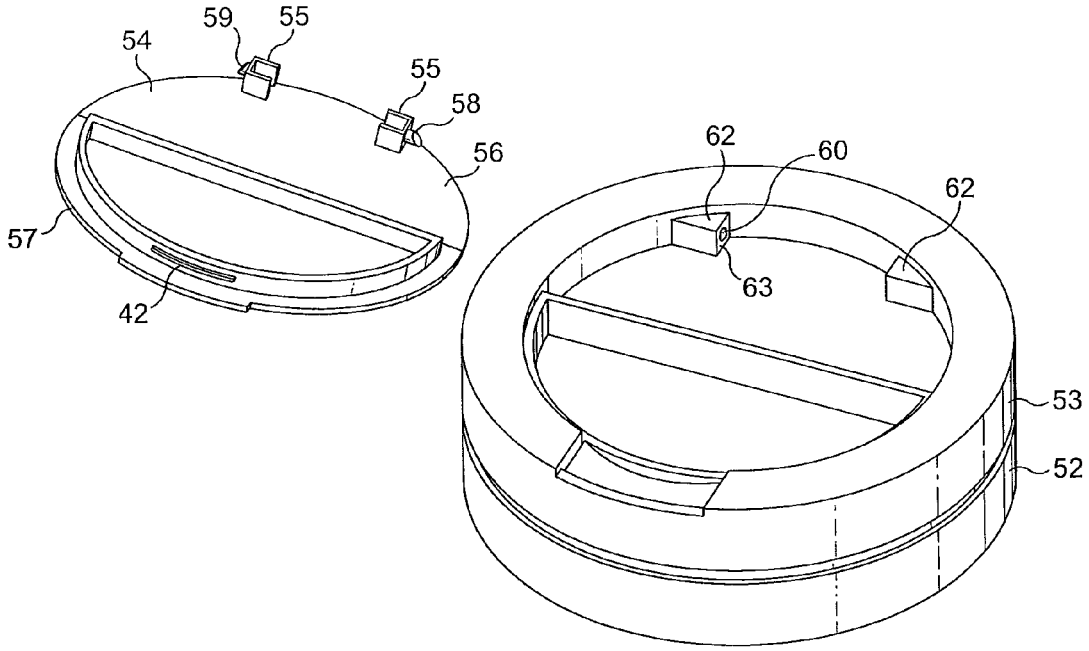
FIG. 9 shows an exploded perspective view of the container for snus shown in FIG. 6 with the cover detached from a lid of said container.

When assembled, the cover 4 is pivotally mounted to the lid 3 and the cover 4 is initially disposed in a closed position (as shown in FIG. 3), wherein the cover 4 is disposed in an upper part of the recess 17 to enclose the secondary compartment 6 defined by the first chamber 20 and the cover 4. The cover 4 is held in its closed position and prevented from rotating relative to the lid 3 and about itself by the flange rib 42 locating over the panel rib 31 and being retained thereby. The lid 3 is inserted over the base 2 of the container 1 such that the lid side wall 13 overlaps the base side wall 9 and is removably mounts thereto such that the main storage compartment 5 is sealed.

Fresh product in the form of smokeless tobacco products such as snus or snuff is stored in the main storage space 5. A user obtains fresh product from the main storage space 5 by holding the lid 3 and base 2 in each hand and pulling the two components apart. The user may then retrieve a quantity of smokeless product therefrom.

To obtain access to the secondary compartment 6, in which it is envisaged that used product, such as used snuff or snus, will typically be stored, a user holds the container 1 and exerts a downward force on the push section 38 of the cover 4. The push section 38 is urged to rotate about the primary hinge 30 along its axis and so urges the hinge section 39 to act on the upper end of the fulcrum wall 18, and rotate about the secondary hinge 37. However, initially the hinge section 39 is prevented from rotation by the flange rib 42 locating over the panel rib 31 and being retained thereby. Therefore, a user must apply a sufficient force to the push section 38 to impel the flange rib 42 to displace over the panel rib 31. The hinge section 39 is then free to move from its closed position to its open position by the hinge section 39 acting on the fulcrum wall 18 and rotating about the secondary hinge as the push section 38 is urged into the second chamber 21. The chamfer on the upper end 24 of the fulcrum wall 18 aids the pivoting of the pivot section 38 about the fulcrum wall 18. The lower face 33 of the hinge section 39 slides relative to the fulcrum wall 18 as the hinge section 39 is rotated, and the push section 38 rotates until its end proximate to the secondary hinge 37 contacts the base of the second chamber 21. The second chamber 21 has a depth determined to limit the movement of the push section, such that when the push section at the hinge line contacts the base of the second chamber 21, then the push section is prevented from further rotation. The hinge section 39 is then upstanding from the second cavity 21 of the compartment 17 and the first cavity 20 is accessible.

To move the cover 4 into its closed position from its open position, a user exerts a force on the hinge section 39 and urges it to rotate into the closed position, relative to the push section 38, and pivot about the upper end 24 of the fulcrum wall 18. The hinge section 39 of the cover 4 is moved to enclose the first cavity 20 of the compartment 17 and the push section is therefore urged upwardly out of the second cavity 21. The flange rib 42 is then urged to locate over the panel rib 31 to fixedly locate the cover 4 in its closed position, with the hinge section 39 and the push section 38 lying on the same plane and the hinge section 39 locating against the shoulder 23.

With the arrangement of the above embodiment, it is also possible for a user to move the hinge section 39 into an open position by inserting a finger into the access cavity 25 and applying an upward force on the lip 36 of the cover 4 without using the above push mechanism. The flange rib 42 is then urged over the panel rib 31 and the hinge section 39 rotates relative to the push section 38. If a user opens the cover 4 in this manner, it is also possible to rotate the cover 4 about the primary hinge 30 to gain access to the second chamber 21 of the compartment 17.

Although the container for snus has been described to include an access recess 25 to allow the hinge section 39 to be pivoted about the push section 38 without pushing the push section to cause the hinge section 39 to act on the fulcrum wall 18, it should be realised that the container may be formed without the access recess 25. An advantage of the access recess 25 is that it is possible for a user to move the cover 4 into an open position without using the push mechanism by inserting a finger into the access recess 25 and levering the lip 36 of the cover 4 upwardly. Therefore, it is possible to temporarily store products in both the first chamber 20 and the second chamber 21 and access them without using the push mechanism. In this embodiment it is possible to rotate the push section 38 of the cover 4 upwardly due to the projecting portion 35 being disposed in the hinge cavity 26 and so allowing the cover a wide range of motion.

A second exemplary embodiment of the invention will now be described with reference to FIGS. 5 to 9. In this embodiment, the container for snus is generally the same as for the first embodiment, and so a detailed description will be omitted herein. Elements of the container for snus which are generally the same as for the first exemplary embodiment described above retain the same reference numerals, however in this embodiment the arrangement of the primary hinge is different.

Referring now to FIGS. 5 to 9, a container for snus 51 is shown. The container for snus 51 comprises a base 52, a lid 53 and a cover 54. The lid 53 is generally the same as the lid 3 of the previous embodiment described above and includes the compartment 17, except in this embodiment a hinge cavity is omitted. Similarly, in this embodiment, the cover 54 is generally the same as the cover 4 of the previous embodiment, except in this embodiment a pair of first hinge portions 55 extend below the plane of a cover lower face 56 but does not extend outwardly from a circumferential edge 57 of the cover 54.

The first hinge portions 55 extend downwardly from the cover lower face 56 and are inset from the edge 57 of the cover 54. A pivot rod 58 extends from each projecting portion 55 in opposing directions, and the pivot rods define the axis of rotation of the primary hinge 30, as will become apparent hereinafter. Each pivot rod 58 has an angled end face 59, which enables the pivot rod 58 to be inserted into a corresponding pivot hole 60, as described below.

A pair of second hinge portions 62 are formed in the second chamber 21 of the compartment 17. Each second hinge portion 62 has an opposing face 63 with a pivot hole 60 formed therein which is arranged to receive a corresponding pivot rod 58 of the cover 54 such that the pivot rods 58 are rotatable therein to form a primary hinge 64 such that a push section 65 of the cover 54 is rotatable about the primary hinge 64. When the container for snus 51 is assembled, an upper end of each second hinge portion 62 is spaced from the cover lower face 56 such that the push section is rotatable about the second hinge portion 62 without the cover lower face 56 impacting said second hinge portion 62 when the cover is moved from a closed position to an open position, as described above for the first exemplary embodiment.

Although in the above embodiments the cover is retained in a closed position by a rib formed on the cover locating over a corresponding rib on the lid, it will be understood that the invention is not limited thereto, and that alternative means may be used to retain the cover in a closed position.

In an alternative embodiment, the compartment 6 holding consumed snus may be divided into a plurality of compartments or spaces.

It should be realised that the container may assume a wide variety of shapes or that some components of the container will be shaped differently to the remaining components. For example, the cover may assume a different shape to the lid and the outer boundaries of the recess may correspond to a non-circular cover.

Although embodiments of the invention have been shown and described, it will be appreciated by those skilled in the art that variations may be made to the above exemplary embodiments that lie within the scope of the invention, as defined in the following claims.

The invention claimed is:

1. A snus container comprising:

a base and a lid defining a main compartment, the lid being formed with an access cavity and a secondary compartment for receiving used snus;

a cover, said cover enclosing the secondary compartment, the cover having a lip and a hinge line extending thereacross to divide said cover into a push section and a hinge section; and a fulcrum wall upstanding from a base of the secondary compartment;

wherein the hinge section includes a flange, said flange being recessed from the edge of the periphery of the hinge section;

wherein a retaining flange rib is formed on an outer surface of the flange;

wherein the hinge section is rotatable relative to the push section about the hinge line and the push section is pivotally mounted to the secondary compartment such that, when a user urges the push section into the secondary compartment, the hinge section acts on a fulcrum and is urged to rotate about the hinge line relative to the push section to move the hinge section from a closed position to an open position and allow access to the secondary compartment;

wherein the access cavity is divided from the secondary compartment by a panel, and is distal to the pivotal mounting of the push section to the secondary compartment; and wherein the lip extends from a circumferential edge of the cover substantially opposite to the pivotal mounting of the push section to the secondary compartment, over the panel, and partially covers the access cavity when the hinged section is in the closed position.

2. The snus container according to claim 1, wherein the fulcrum is disposed in the secondary compartment.

3. The snus container according to claim 2, wherein the fulcrum divides the compartment into two discrete chambers.

4. The snus container according to claim 3, configured such that product is stored in one of the two discrete chambers and the push section is urged into the other discrete chamber.

5. The snus container according to claim 2, wherein the fulcrum is a wall upstanding in the compartment.

6. The snus container according to claim 1, wherein the cover is pivotally mounted to the lid by a hinge.

7. The snus container according to claim 6, wherein the hinge comprises a hinge cavity extending from the secondary compartment and a projecting portion extending from a portion of the circumferential edge of the cover which is disposed in the hinge cavity and pivotally mounted to side walls of said hinge cavity.

8. The snus container according to claim 6, wherein the hinge comprises a first hinge portion extending from a lower face of the cover and a second hinge portion upstanding in the secondary compartment, wherein the first hinge portion is pivotally mounted to the second hinge portion.

9. The snus container according to claim 1, wherein the hinge line comprises a line of reduced thickness formed in the cover.

10. The snus container according to claim 9, wherein the line of reduced thickness is a channel formed in the lower surface of the cover.

11. The snus container according to claim 10, wherein the cover is circular.

12. The snus container according to claim 1, wherein the retaining flange rib is configured to latch in the compartment to retain the cover in the closed position.

13. The snus container according to claim 1, wherein the cover is connected to the lid via pivot rods.

14. The snus container according to claim 1, wherein an access cavity opening lies in the same plane as the cover when closed.

15. The snus container according to claim 1, wherein the access cavity is walled in at a circumferential edge of the lid.

* * * * *

UNITED STATES PATENT AND TRADEMARK OFFICE

CERTIFICATE OF CORRECTION

PATENT NO. : 8,869,980 B2
APPLICATION NO. : 13/381324
DATED : October 28, 2014
INVENTOR(S) : Adam Berggren It is certified that error appears in the above-identified patent and that said Letters Patent is hereby corrected as shown below:

On the title page:

Item (73) Assignee
"Fielder" should read --Fiedler--

Signed and Sealed this
Second Day of June, 2015

Michelle K. Lee

Michelle K. Lee
*Director of the United States Patent and Trademark Office*